US008425171B2

(12) United States Patent
Mortensen et al.

(10) Patent No.: US 8,425,171 B2
(45) Date of Patent: Apr. 23, 2013

(54) PIPE HANDLING SYSTEM AND METHOD

(75) Inventors: Asbjørn Mortensen, Singapore (SG); Kok Seng Foo, Singapore (SG); Rune Henriksen, Singapore (SG); Yeong Jin King, Singapore (SG)

(73) Assignee: Keppel Offshore & Marine Technology Centre Pte Ltd., Singapore (SG)

( * ) Notice: Subject to any disclaimer, the term of this patent is extended or adjusted under 35 U.S.C. 154(b) by 0 days.

(21) Appl. No.: 13/294,788

(22) Filed: Nov. 11, 2011

(65) Prior Publication Data

US 2012/0093614 A1 Apr. 19, 2012

Related U.S. Application Data

(62) Division of application No. 12/364,230, filed on Feb. 2, 2009, now abandoned.

(60) Provisional application No. 61/006,809, filed on Jan. 31, 2008.

(51) Int. Cl.
*E21B 19/00* (2006.01)

(52) U.S. Cl.
USPC ..... 414/22.66; 211/70.4; 211/70

(58) Field of Classification Search ..... 198/614, 198/773, 776; 211/70, 70.4; 221/119, 120, 221/122; 414/22.51, 22.54, 22.61–22.69, 414/22.71, 23, 277, 525.9, 531, 745.4, 745.5, 414/745.9, 746.2, 746.6
See application file for complete search history.

(56) References Cited

U.S. PATENT DOCUMENTS

| | | | | | |
|---|---|---|---|---|---|
| 1,693,086 | A | * | 11/1928 | Laird | 221/122 |
| 2,186,151 | A | | 1/1940 | Roberts | |
| 3,871,534 | A | * | 3/1975 | Bursk | 414/525.9 |
| 3,913,753 | A | * | 10/1975 | Swartz et al. | 414/22.66 |
| 4,229,124 | A | * | 10/1980 | Frey et al. | 405/303 |
| 4,445,579 | A | | 5/1984 | Bello | |
| 4,762,185 | A | | 8/1988 | Simpson | |
| 4,838,749 | A | * | 6/1989 | Potocjnak | 414/277 |
| 5,174,389 | A | | 12/1992 | Hansen | |
| 5,244,329 | A | | 9/1993 | McGill et al. | |
| 5,397,005 | A | | 3/1995 | Taccolini | |
| 5,423,390 | A | | 6/1995 | Donnally et al. | |

(Continued)

FOREIGN PATENT DOCUMENTS

| | | |
|---|---|---|
| EP | 0 182 500 A1 | 5/1986 |
| EP | 0 796 978 A2 | 9/1997 |

(Continued)

*Primary Examiner* — Gregory Adams
(74) *Attorney, Agent, or Firm* — Dickstein Shapiro LLP

(57) ABSTRACT

A racking assembly for receiving and storing at least one pipe. The racking assembly comprises a set back assembly including a selectively rotatable member having a plurality of radial slots sized for receiving a portion of the pipe(s) in sliding engagement, and a base for supporting the pipe(s). The base is coupled to the selectively rotatable member so as to permit mutual rotation. A barrier is located about a peripheral edge of the base, such that the setback assembly rotates relative to the barrier. The barrier is arranged to prevent the pipe(s) from moving radially from the base. The barrier has a gap sized to permit selective lateral movement of the pipe(s). Mutual rotation of the selectively rotatable member and the base permit alignment of the gap and a selected slot of the selectively rotatable member, and thus permits the pipe stands to be moved laterally into the setback assembly.

17 Claims, 14 Drawing Sheets

U.S. PATENT DOCUMENTS

| | | | | |
|---|---|---|---|---|
| 5,954,209 | A | 9/1999 | Wurm et al. | |
| 6,763,898 | B1 | 7/2004 | Roodenburg et al. | |
| 2007/0286707 | A1 * | 12/2007 | Eddowes et al. | 414/22.51 |
| 2008/0128167 | A1 | 6/2008 | Eriksen | |
| 2008/0164064 | A1 | 7/2008 | Belik et al. | |
| 2009/0196712 | A1 * | 8/2009 | Mortensen et al. | 414/22.68 |

FOREIGN PATENT DOCUMENTS

| | | | |
|---|---|---|---|
| EP | 0 979 924 | A2 | 2/2000 |
| WO | WO 84/01599 | A | 4/1984 |
| WO | WO 02/18742 | | 3/2002 |

* cited by examiner

PIPE HANDLING SYSTEM AND METHOD

This is a divisional of U.S. application Ser. No. 12/364,230, filed Feb. 2, 2009, now abandoned, which claims the benefit of U.S. Provisional Application Ser. No. 61/006,809, filed on Jan. 31, 2008.

FIELD OF THE INVENTION

The invention relates to the manipulation and control of pipe stands used in for instance the petrochemical industry. In particular, the invention relates to the control of pipe stands, as they are disengaged from drill strings on extraction from a well bore.

BACKGROUND OF THE INVENTION

On the completion of the drilling of a well bore, which maybe up to several hundred metres deep, the removal of pipes can be a time consuming exercise. Further, as the pipes are of a considerable size, for instance up to 200 mm (9⅝") in diameter and up to 9.1 metres (30') long these pipes also present problems in handling in an efficient and safe manner. This is particularly so for applications where a pipe stand (that is 3 pipes joined) are stored, and so having a section 27.4 metres (90') in length.

As the pipes are withdrawn, one method of controlling and storing the pipe stand is to individually lift them into a rack as the drill string is extracted. However, the time taken for each pipe to be moved in such a manner, can be a considerable. Further it is a logistically difficult exercise to both lift and move a pipe into a rack particularly for the first pipe within the rack as the lateral distance to be moved maybe significant. It follows that during this activity accidents may occur during replacement within the rack and therefore present a safety problem.

SUMMARY OF INVENTION

It is therefore an object of the present invention to improve either speed of handling or safety, as compared to systems of the prior art.

In a first aspect the invention provides a racking assembly for receiving and storing at least one pipe, the racking assembly comprising a setback assembly including a selectively rotatable member having a plurality radial slots sized to receive a first portion of the at least one pipe in sliding engagement, and a base placed distal from the selectively rotatable member and coupled thereto so as to permit mutual rotation, said base arranged to support the at least one pipe on a support face of said base; a barrier located about a peripheral edge of the base, such that the setback assembly rotates relative to the barrier, said barrier arranged to prevent the at least one pipe from moving radially from said base, said barrier having a gap sized to permit selective lateral movement of the at least one pipe; wherein mutual rotation of the selectively rotatable member and the base permit alignment of the gap and a selected slot of said selectively rotatable member, and so permitting the pipes stands to be moved laterally into said setback assembly.

In a second aspect the invention provides a method of receiving and storing at least one pipe, the method comprising the steps of: providing a setback assembly, said setback assembly including a selectively rotatable member with a plurality radial slots and a base placed distal from the selectively rotatable member and coupled thereto so as to permit mutual rotation; engaging the pipe in any of said slots and; moving the pipe laterally so as to slide along said slot and be placed on said base.

In a third aspect the invention provides a guide assembly for receiving a pipe and moving said pipe to an outlet position, the assembly comprising a first and second support assembly for engaging the pipe, said assemblies in spaced relation to engage distal portions of said pipe; said support assemblies arranged to rotate as a single entity so as to rotate the pipe from an engaging position to the outlet position.

In a fourth aspect the invention provides a method for receiving a pipe and moving said pipe to an outlet position, the method comprising the steps of: engaging the pipe with a first and second support assembly, said assemblies in spaced relation to engage distal portions of said pipe; rotating said support assemblies and so rotating the pipe from an engaging position to the outlet position.

In a fifth aspect the invention provides a pipe delivery system comprising a base to which pipes are delivered; a support block for supporting a plurality of pipe; said base having at least one slot sized to allow the support block to project from or retract into said base, said slot further sized to prevent said pipe to pass there through; wherein the support block is arranged to move along said slot, projecting from said slot with said pipe and to selectively retract below said base so as to position the pipe on said base.

In a sixth aspect the invention provides a method of delivering a plurality of pipes to a base, the method comprising the steps of: supporting the plurality of pipes on a support block; projecting the support block from a slot in said base; moving the support block along said slot whilst projecting from said slot with said pipes and; selectively retracting below said base so as to position the pipes on said base.

In one aspect, the invention provides for a more direct lateral placement of the pipe or pipe stand, instead of, for instance, a lift and drop system. This may increase the speed of positioning; as well avoid injury during the dropping step.

In a further aspect the lateral movement or delivery of the pipe into the rack may be provided as array of pipes (or pipe stands) with the delivery system moving several pipe stands in one movement into the rack in a controlled environment.

It will be noted that the invention is equally applicable to the storage of both pipes and pipe stands. Accordingly, these terms may be interchanged without limiting the scope of the invention, unless specifically identified as such.

BRIEF DESCRIPTION OF DRAWINGS

It will be convenient to further describe the present invention with respect to the accompanying drawings to illustrate possible arrangements of the invention. Other arrangements of the invention are possible and consequently the particularity of the accompanying drawings is not to be understood as superceding the generality of the preceding description of the invention.

DETAILED DESCRIPTION

Figure 1A:
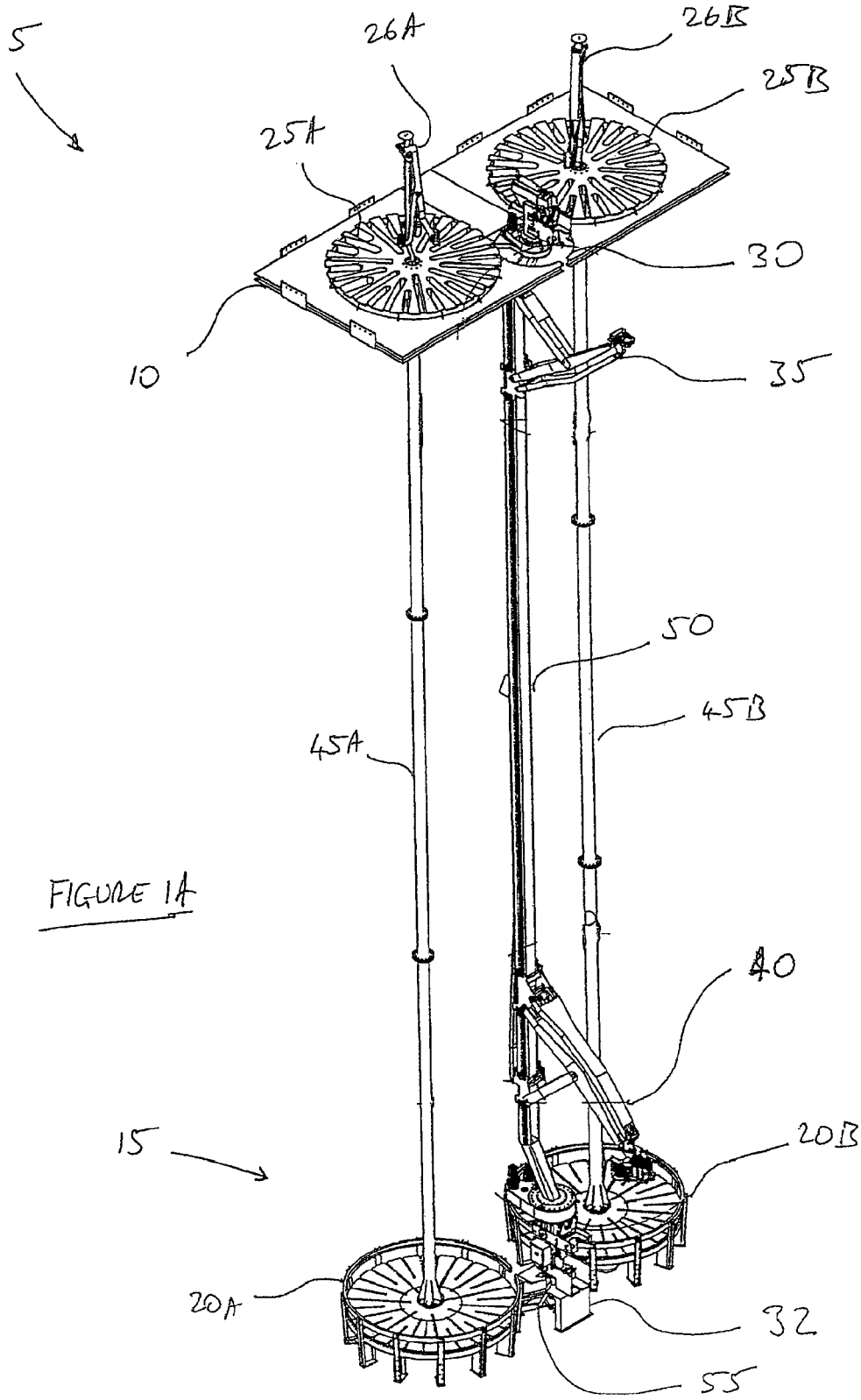
FIGS. 1A to 1C show various views of a setback assembly according to one embodiment of the present invention.
Figure 1B:
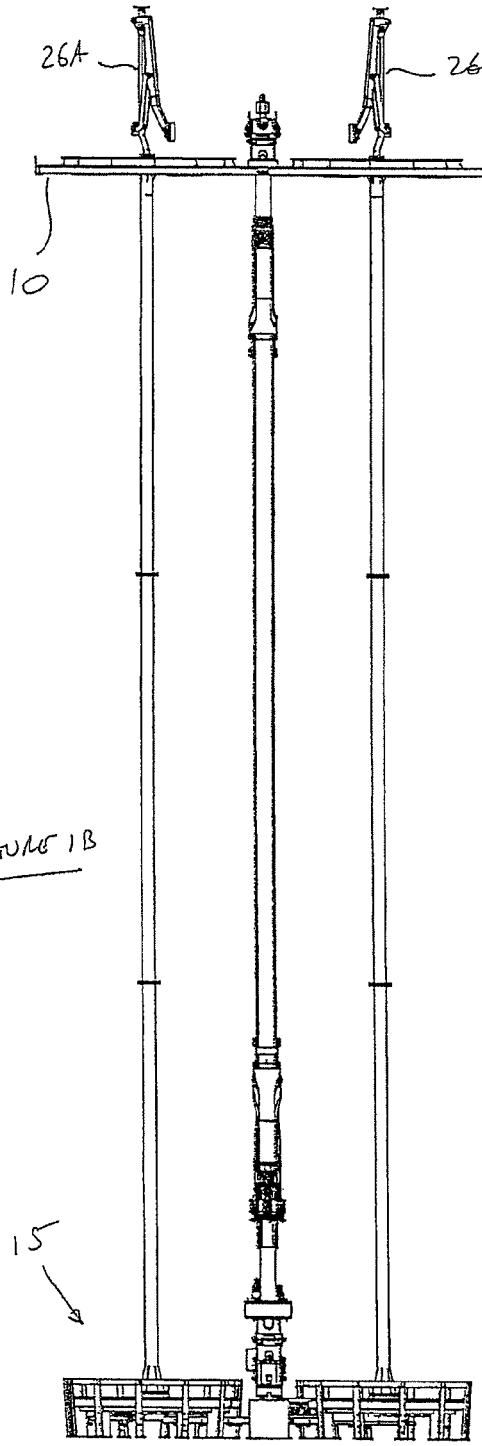
Figure 1C:
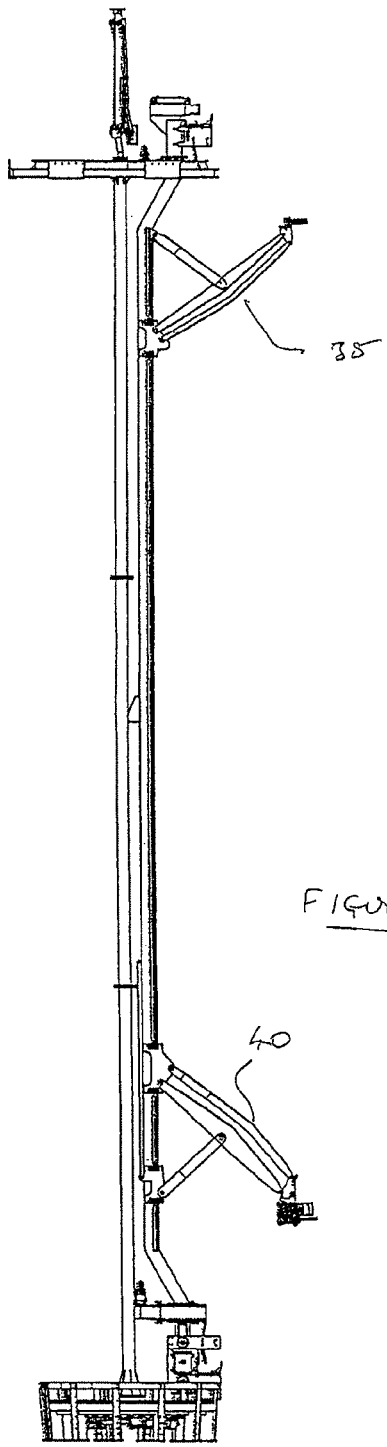

FIGS. 1A, 1B and 1C show a racking assembly designed to receive and store pipes, or pipe stands, as they are removed from a well center. Drill strings comprise individual pipe stands which are connected as the bore is drilled deeper in order to meet the exploration or hydrogen extract objective. On completion of the objective the drill string will be removed with the pipe stands each disconnected from the drill string as each pipe stand fully emerges from ground, or water in the case of drilling from a ship.

Each pipe can be up to 6 meters (30') long and up to 200 mm (9⅝") in diameter, with a pipe stand typically relating to 3 pipes connected in series and so 3 times the length. Further the wall thickness of the pipe may be considerable such as up to 25 mm and therefore each pipe stand will be of significant weight. The target rate of disengaging each pipe stand and storing ready for further withdraws of the drill string is 60 stands an hour, or one minute per stand. It will be appreciated that this is a significant rate and may not be achieved by many, if any, existing systems. Accordingly the present invention seeks to accelerate the rate of processing of the pipe stands and therefore includes features arranged to either accelerate such processing or maintain acceptable rates at far higher levels of safety than are currently available according to the prior art.

FIGS. 1A to 1C show one embodiment of the present invention. A racking assembly 5 includes a fingerboard assembly 10 at the top of the racking assembly 5 with a base assembly 15 at the bottom. In this embodiment the racking assembly includes two parallel setback assemblies made up of a fingerboard 25*a*, 25*b* corresponding to a base 20*a*, 20*b*. Each setback assembly acts independently in this case and in fact the invention requires only one such setback assembly with the second setback assembly increasing the overall storage capacity of the device.

The fingerboard 25*a*, 25*b* is connected to the corresponding base 20*a*, 20*b* by a vertical shaft 45*a*, 45*b*. The shaft ensures that each fingerboard and base rotates together, that is mutual rotatability.

The racking assembly 5 further includes a pair of racker arms 35, 40 which engage an upper and lower portion of a pipe stand (not shown) and deliver the pipe stand to the fingerboard and base. In this embodiment a guide assembly, in this case slot machine assembly 30, 32 are included however the racking assembly according to the present invention does not require the intermediate guide assembly.

For convenience the racker arms 35, 40 are mounted to a guide assembly shaft 50. In a further embodiment the racker arms may be conveniently place elsewhere and in fact for further convenience additional pairs of racker arms may be included so as to further engage pipe stands as they become available, subject to the speed and availability of the racking assembly to accommodate such pipe stands, at a faster rate.

Figure 2A:
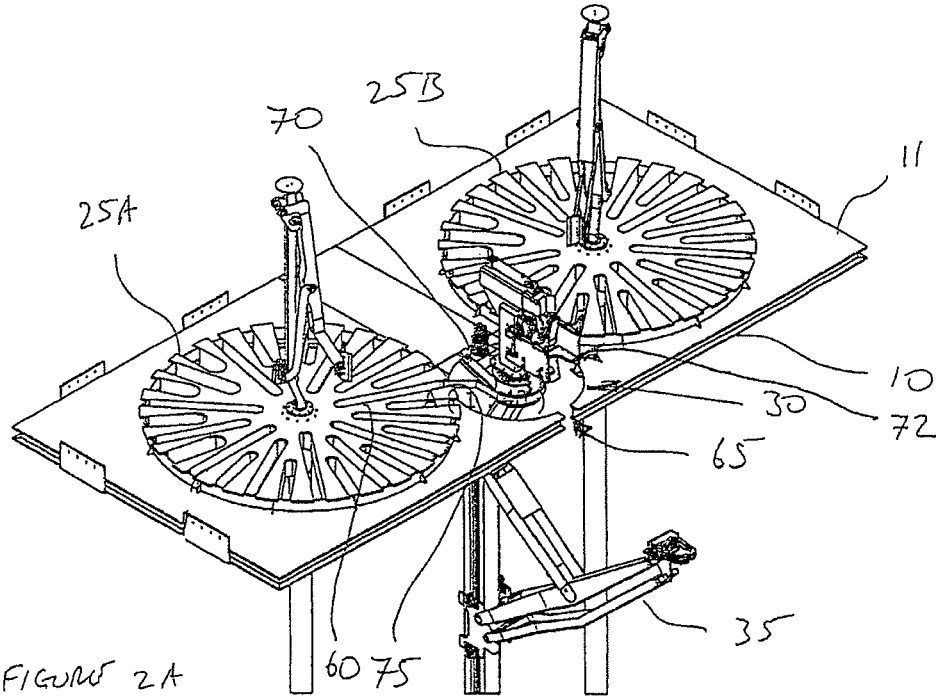
FIGS. 2A and 2B show various views of storage racks according to a further embodiment of the present invention.
Figure 2B:
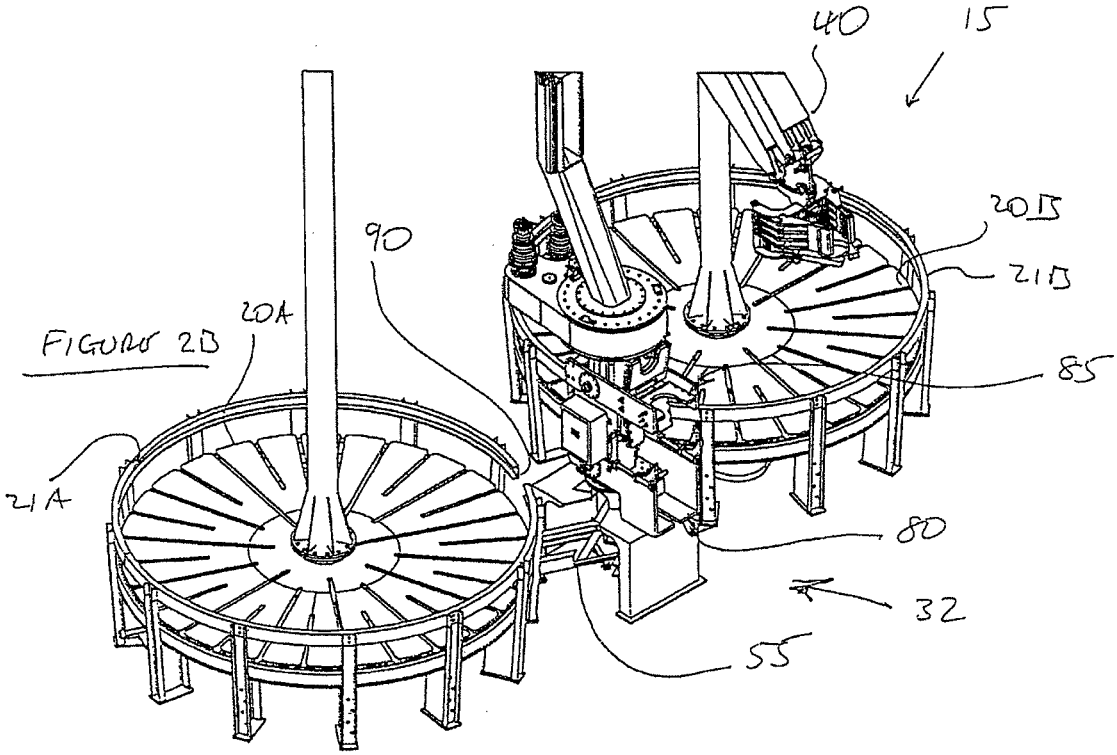

Further shown in this embodiment are fingerboard pushers 26*a*, 26*b* which act to facilitate positioning of the pipe stands once engaged, should this be required. FIGS. 2A and 2B show setback assembly, and in particular the fingerboard assembly 10 and base assembly 15 in greater detail. The fingerboard assembly 10 comprises a fingerboard plate 11 with the two fingerboards 25*a*, 25*b* rotatable within the plane of fingerboard plate 11.

Further included is a recess in which the top guide assembly 30 is located with an inlet 65 through which the upper part of the pipe stand enters the guide assembly as manipulated by the upper racker arm 35. As will be explained in greater detail later, the guide assembly 30 engages the pipe stand as it enters the inlet 65 and rotates so as to deliver the pipe stand to a slot 60 which has been rotated to correspond to the outlet 75. As will further be discussed later, in this embodiment a pipe delivery system such as a cam lifter 55 may act to facilitate the more rapid placement of each pipe stand by the guide assembly placing several pipe stands on the cam lifter 55 before said pipe stands are delivered as an array of pipes into the corresponding slot 60.

FIG. 2B shows the base assembly 15 having two bases 20*a*, 20*b* which correspond to the aforementioned fingerboards 25*a*, 25*b*. As the pipe stand is delivered to the racking assembly the bottom portion of the pipe stand is simultaneously engaged by the lower racker arm 40 and delivered to the bottom guide assembly 32. The top and bottom guide assemblies are synchronized to rotate together to deliver the pipe stand to, in this embodiment, a cam lifter 55 for placement within the assembly. A key feature of the racking assembly according to the present invention is the base arrangement whereby a barrier 21*a*, 21*b* is positioned about an edge of the base. The barrier is fixed relative to the base such that the base will rotate maintaining the barrier in the same position. The barrier 21*a*, 21*b* includes a gap 90 though which the lower portion of a pipe stands may pass. Thus the racking assembly according to the present invention does not require a "lift and drop" placement such as that known in the prior art. A racking system is disclosed in WO02/18742, the contents of which are incorporated herein. This system requires each pipe stand to be lifted and then dropped into a corresponding lower fingerboard so as to be secured. Further the lifting and lowering is achieved by racker arms which must be controllable to a sufficient degree so as to correspond to the slot within the bottom fingerboard. Not only is it time consuming. the lifting and lowering may involve a safety issue given the weight of each pipe stand and the pressure of maintaining a steady storage rate of pipe stands.

By comparison, the racking assembly according to the present invention merely slides each pipe into place and thus eliminating the "lift and drop" approach of the prior art. Each pipe stand or array of pipe stands located within individual slots of the top fingerboard 25*a*, 25*b* are maintained in position by the fingerboard plate 11 at the top and by the barrier 21*a*, 21*b* at the lower portion. A further advantage includes the ease of manufacture of the base as compared to a lower fingerboard according to the prior art, having several slots formed to accommodate the respective pipe stands.

Figure 3A:
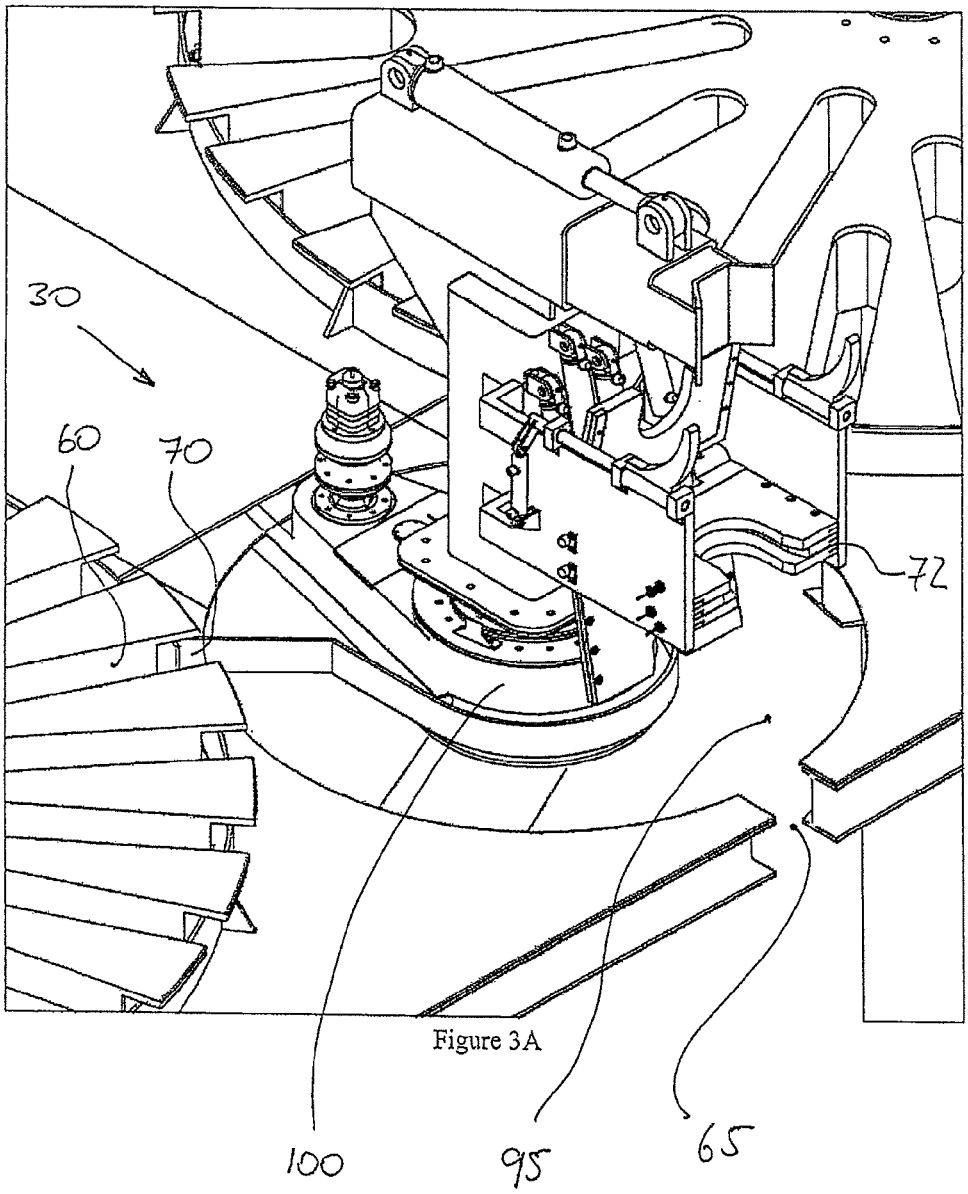
FIGS. 3A and 3B show a guide assembly according to a further embodiment of the present invention.
Figure 3B:
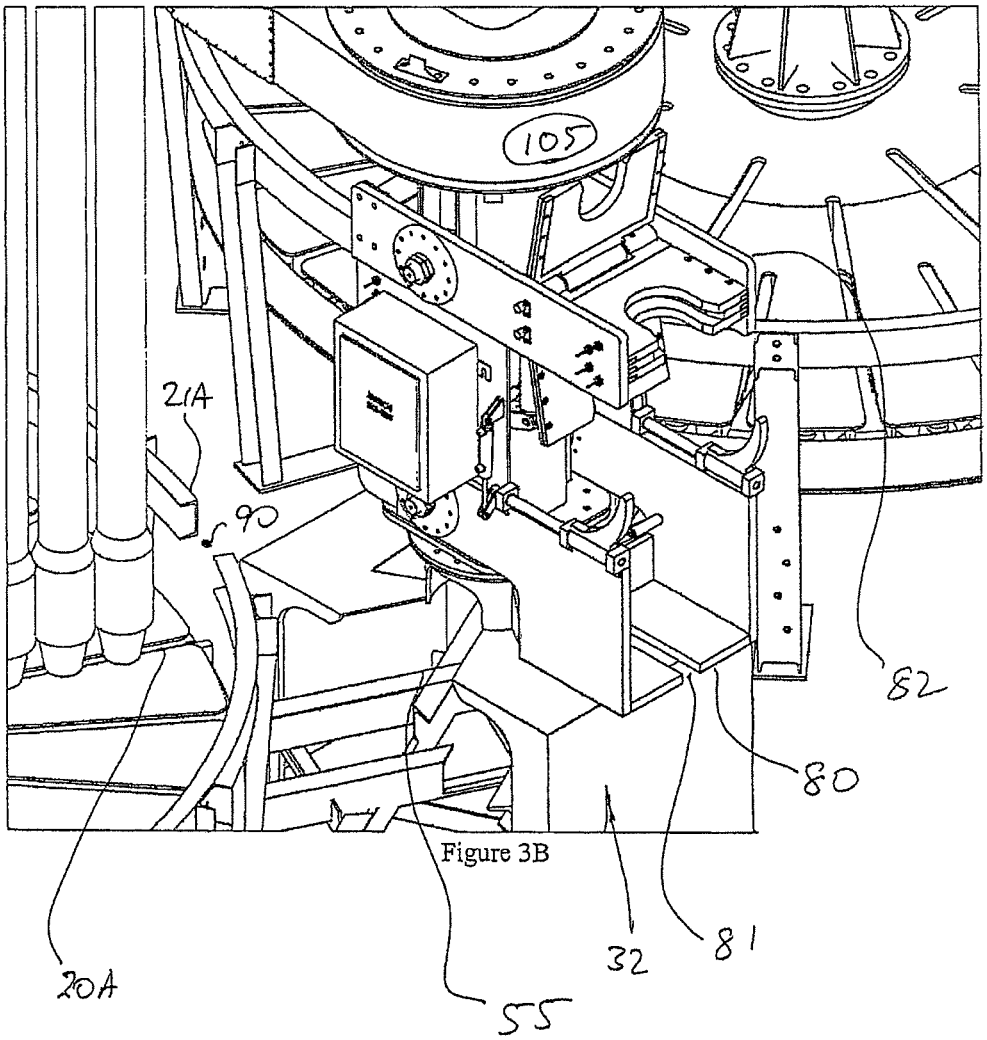
Figure 4A:
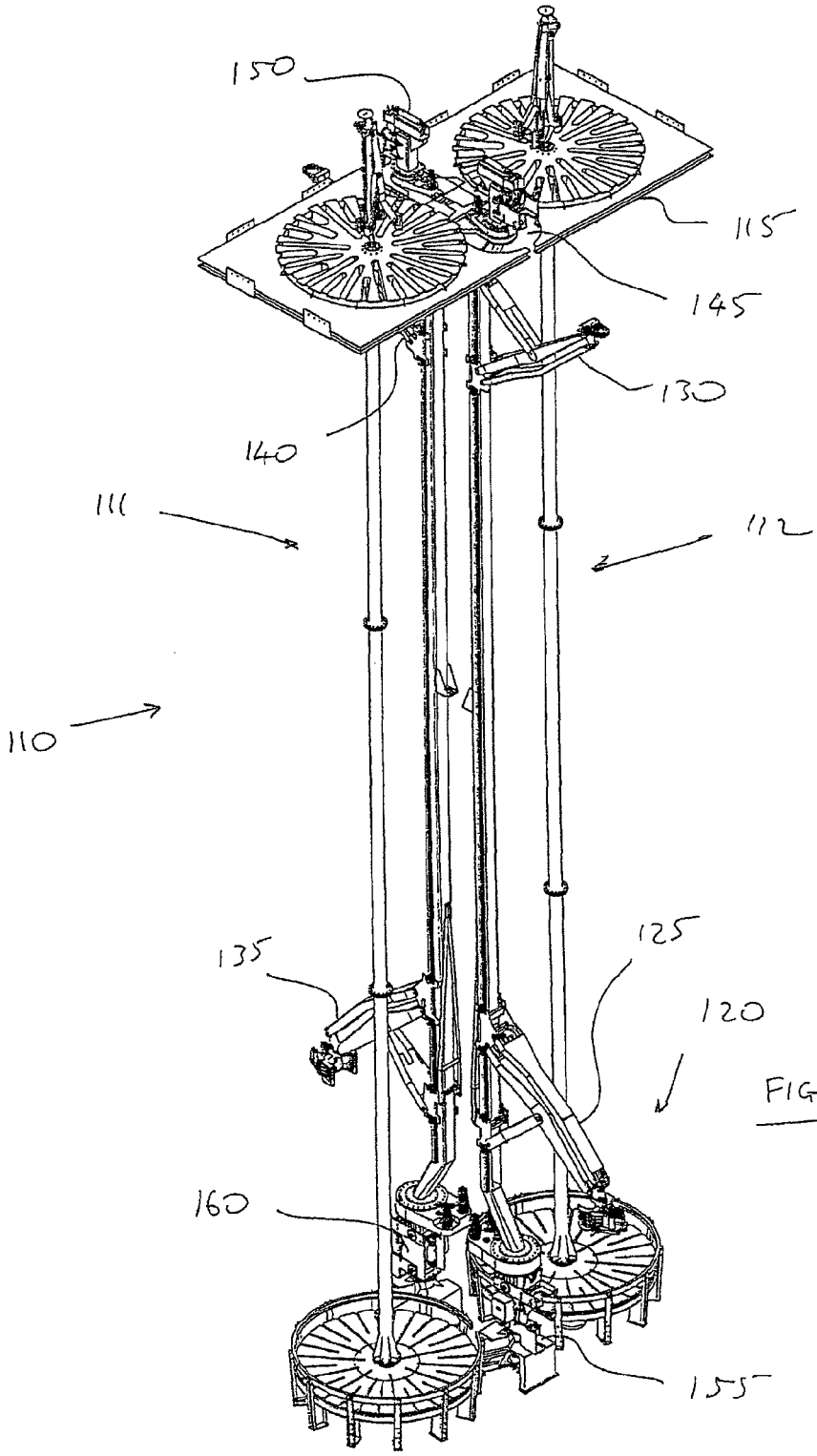
FIGS. 4A to 4D show various views of a racking assembly according to a further embodiment of the present invention.
Figure 4B:
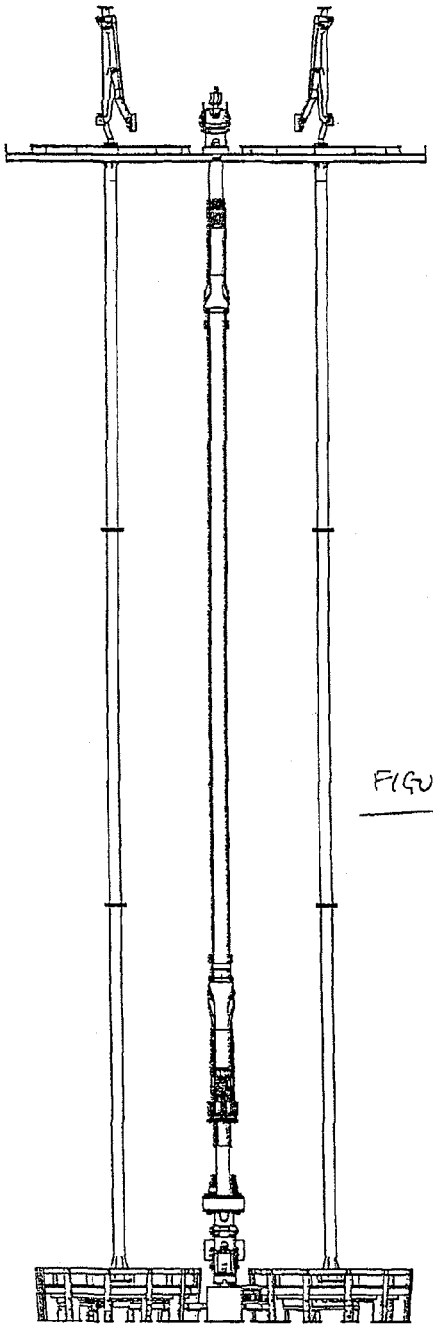
Figure 4C:
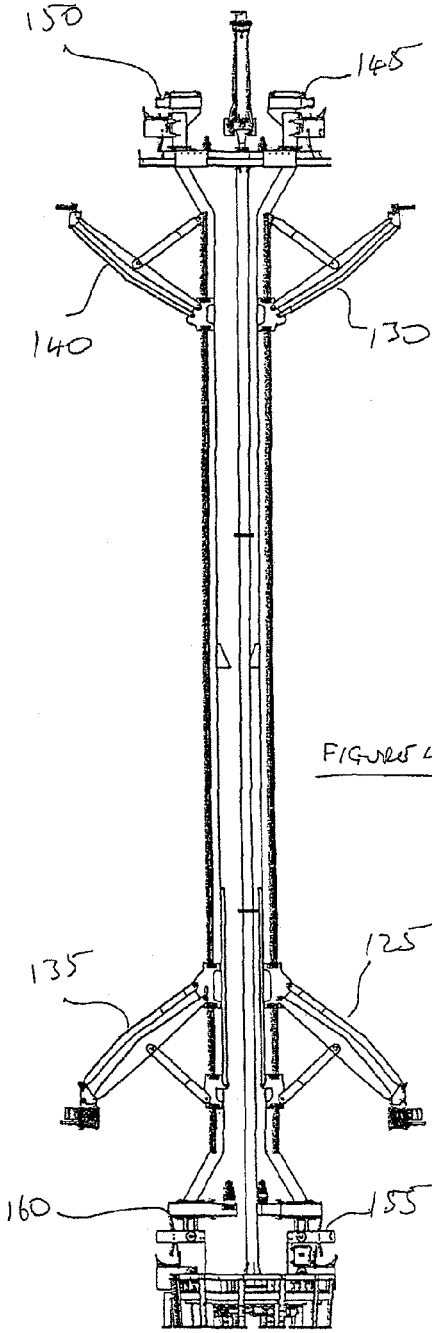
Figure 4D:
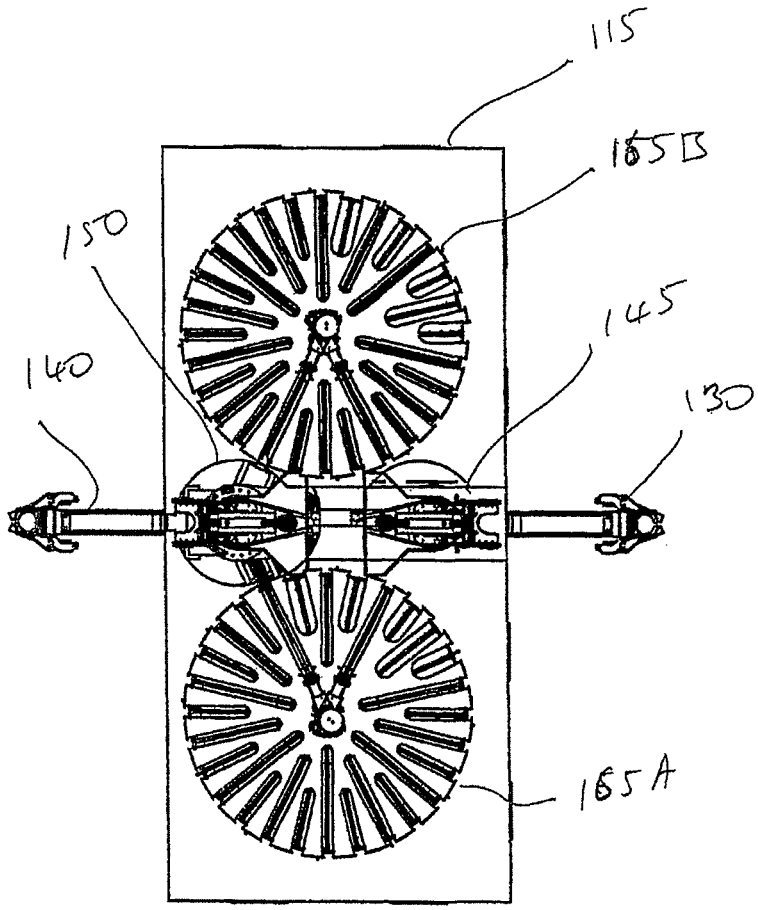

FIGS. 3A and 3B show respective detail views of the upper guide assembly 30 and lower guide assembly 32 according to a further aspect of the present invention. The guide assembly 30, 32 acts as an intermediary placement mechanism. It will be appreciated that the guide assembly 30, 32 may also be incorporated into different racking assemblies. Whilst there is distinct advantage in the use of the racking assembly 5 with the guide assembly 30, 32, advantage can also be gained by using the guide assembly in other systems. Equally the racking assembly 5 also has advantage without the guide assembly 30, 32 compared to the prior art which of course can benefit further by combining these two key elements.

FIG. 3A shows the top guide assembly 30 having a pipe guide 72 which is shaped to guide the shaft of the pipe stand directly below the spigot head of the pipe. Not shown are latches that act to keep the pipe stand in place, and so acting as a mechanical lock, for added prevention of the pipe slipping out of position. Other types of guidance assemblies will be appreciated and the invention is not restricted to this particular type as shown for this embodiment. The pipe stand enters the void 95 through a gap 65 and once engaged with the gripper 72 will rotate about bearing 100 until the pipe stand corresponds with the outlet gap 70. In this embodiment the fingerboard has been rotated so as to present a vacant slot 60 to receive the pipe stand once engaged.

FIG. 3B shows the bottom guide assembly 32 which in this case includes a pipe gripper 82 with a support plate 80. The pipe stand is lifted onto the support plate 80 by the racker arms and then subsequently engaged by the upper gripper 72 and lower gripper 82 so as to control the rotation of the pipe stand by the guide assembly. Slot 81 is further provided, in this embodiment, to assist with the eventual placement of the pipe stand into the setback assembly, and corresponds to slot 215 in the base, as shown in FIG. 5B. The lower guide assembly 32 includes a further bearing 105 which assists with rotation under controlled conditions and corresponds to the rotation of the upper guide assembly 30. As the pipe stand is rotated the lower of the pipe stand is placed upon in this embodiment a delivery system (not shown) which will be described in further detail later. The guide assembly according to the present invention does not require a delivery system such as that shown in FIG. 3B. However, in combination with the delivery system according to a further aspect of the present invention provides further advantage rather than using other processes according to the prior art. Thus on rotation of the pipe stand, the pipe stand may enter through gap 90 so as to be placed on the base 20*a*.

The use of racker arms for engaging a pipe stand is known and is a useful way of engaging a pipe or pipe stand during detachment from the drill string. After detachment of the pipe or pipe stand from the string, the racker arms may also be used for placement, albeit an inaccurate, given the size and weight of such an object. To better control the placement and storage of the pipe stand, the guide assembly, has fewer degrees of freedom and a shorter lever arm and so having a better design both in terms of strength and accuracy. Accordingly, placement of a pipe stand may be more accurate and faster than the use of the racker arms of the prior art. Thus whilst the guide assembly in one embodiment may provide an intermediate step, the speed by which pipe stand can be placed accurately as compared to the use of racker arms provides a distinct advantage over the prior art.

As mentioned whilst the invention is broad enough to include one setback assembly, the arrangement shown in FIGS. 1A to 1C show two setback assemblies working in parallel. One use of the dual setback assemblies may be to allow the first setback assembly to reach capacity which, subject to weight constraints, may be completely full or partially full. Once at capacity, the guide assembly or racker arms may deliver pipe stands to the second setback assembly until that reaches the capacity or the drill string has been completely withdrawn and the pipe stands stored.

FIGS. 4A to 4D show a further embodiment of the present invention with a different type of racker assembly 110. In fact the embodiment shown in FIGS. 4A to 4D is similar to that shown in FIGS. 1A to 1C whereby two setback assemblies are provided. However together with a first set of racker arms 125, 130 as provided with the earlier embodiment, there is also provided a second set of racker arms 135, 140. Further two sets of guide assemblies 145, 155, 150, 160 are provided with each corresponding to one of the pairs of racker arms. The embodiment shown in FIGS. 4A to 4D is intended to show an arrangement that can accommodate two well centers within the same racking assembly 110. In this embodiment, the first guide assembly 145, 155 works with the first pair of racker arms 125, 130 to service the first well center. It follows that the second guide assembly 150, 160 works with the second pair of racker arms 135, 140 to service the second well center. This arrangement may therefore have the first well center service by the first setback assembly 111 and the second well center service by the second setback assembly 112. Alternatively, subject to logistics and control systems the first setback assembly 111 may receive pipe stands from both well centers until it has reached capacity and then the second setback assembly 112 will receive pipe stands from both well centers until each drawstring has been extracted and stored. Which particular process to adopt will depend on the circumstances and is not a limitation of the present invention.

In a further aspect of the present invention, a further device which acts to increase the speed of placement of pipe stand both safely and accurately is shown in FIGS. 5A to 5F.

Figure 5A:
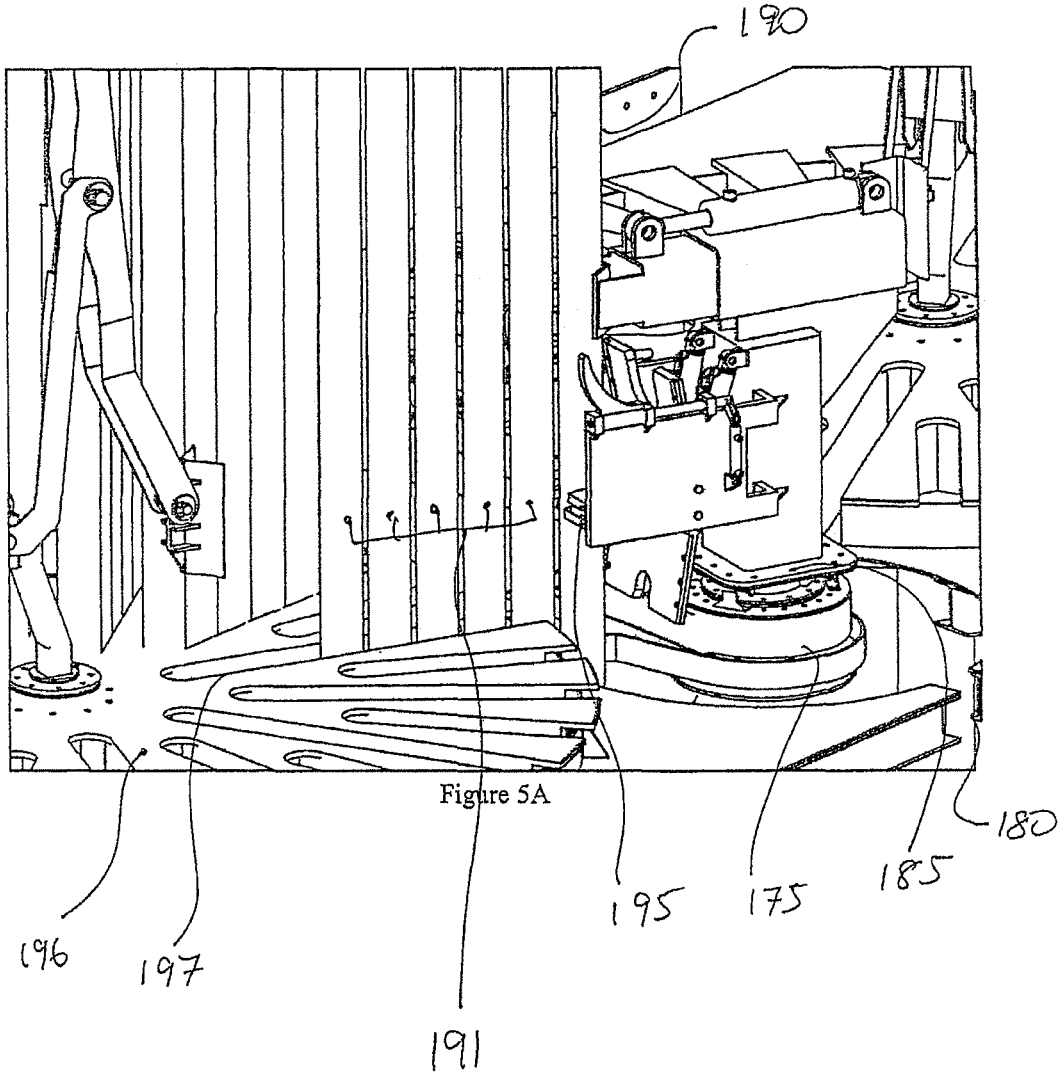
FIGS. 5A to 5F show a delivery system according to a further embodiment of the present invention.
Figure 5B:
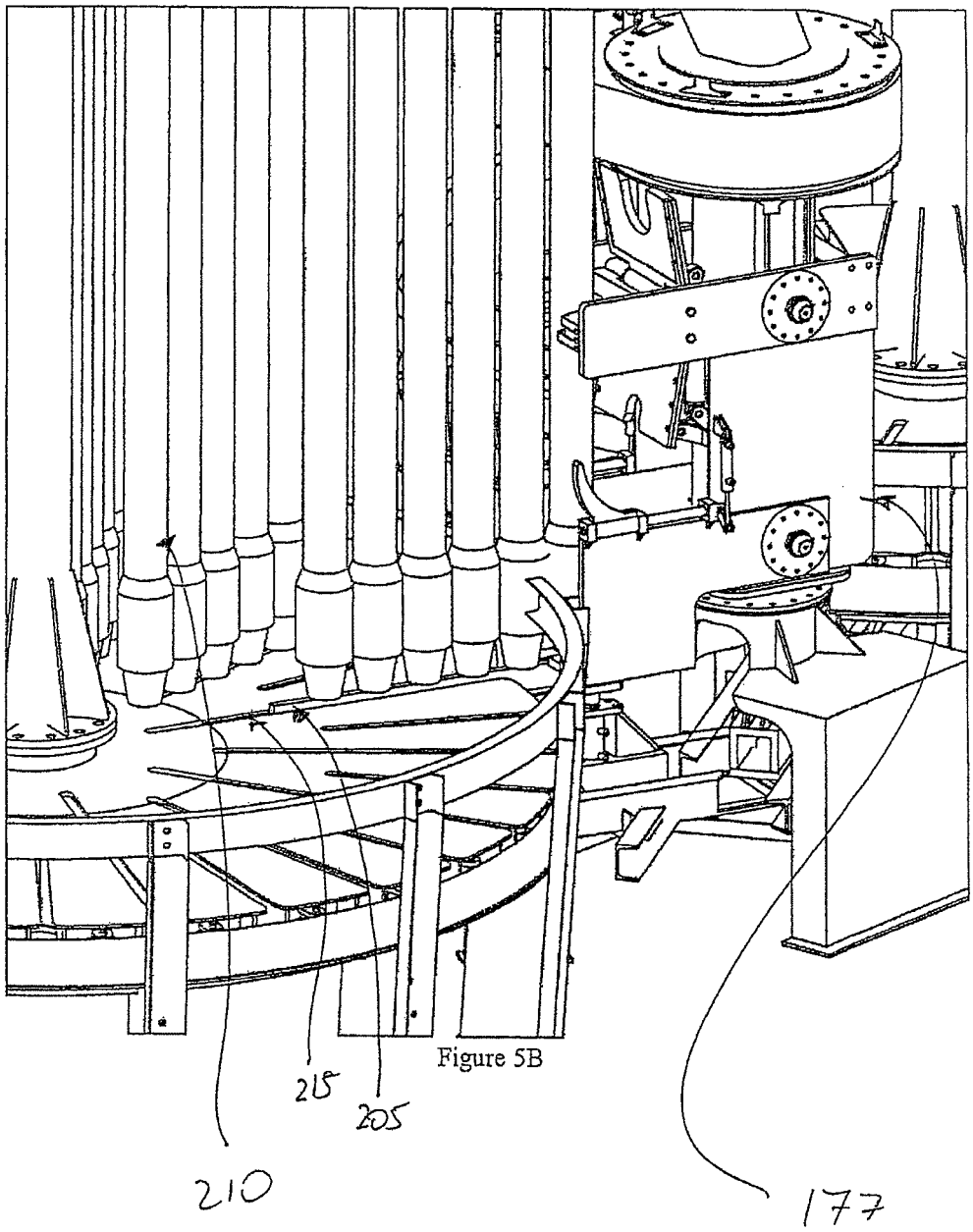

FIG. 5A shows a slot 197 in the finger board 196 into which several pipes 191 have been slid. A first support assembly, in this case a rotatable guide 195 is in the process of delivering a pipe 190 to the slot 197, having rotated about bearing 175. The first support assembly acts to support the upper. As will be explained in more detail, the pipe has previously been received through a gap 180 having been delivered by a set of racker arms (not shown).

Figure 5C:
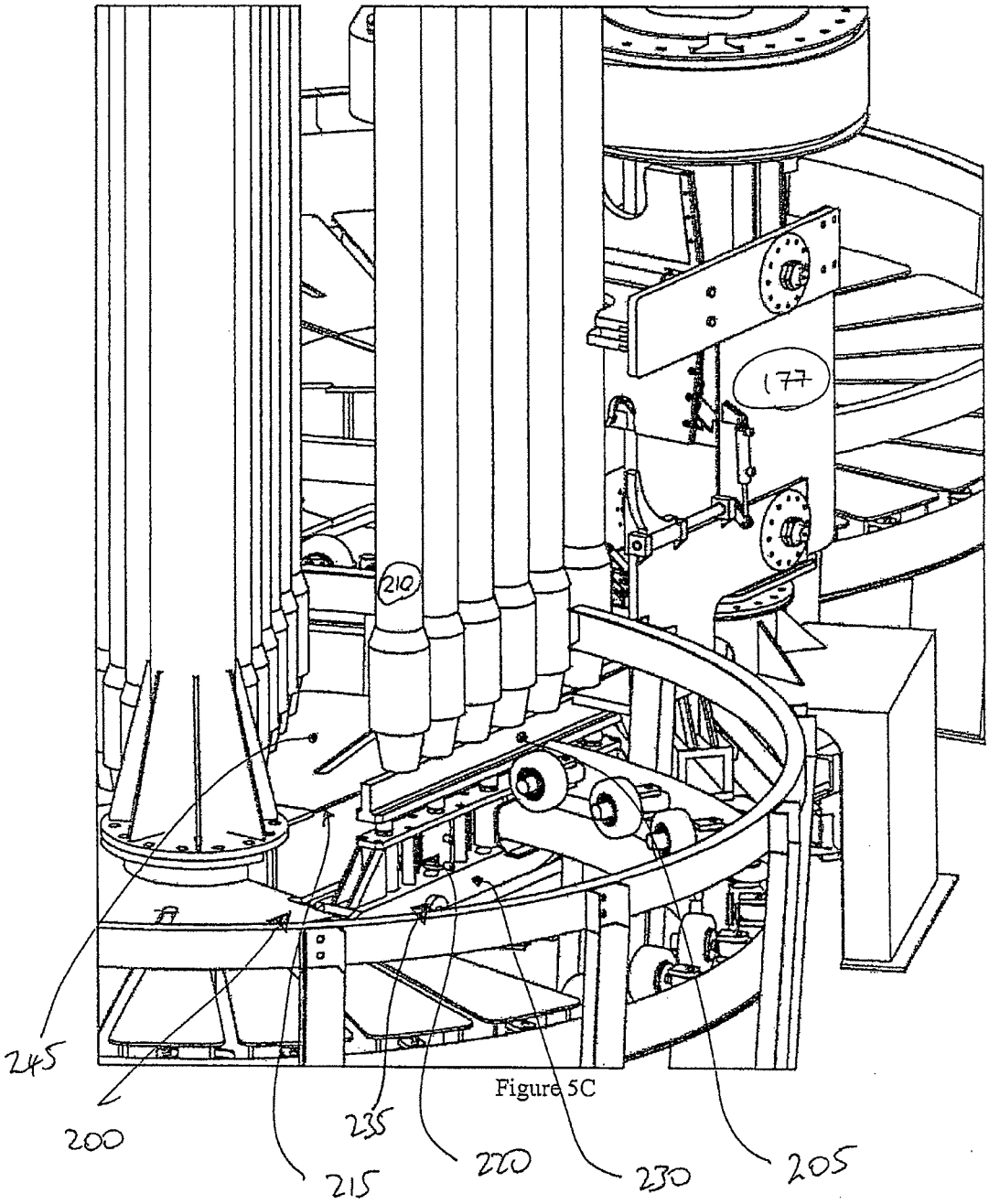
Figure 5D:
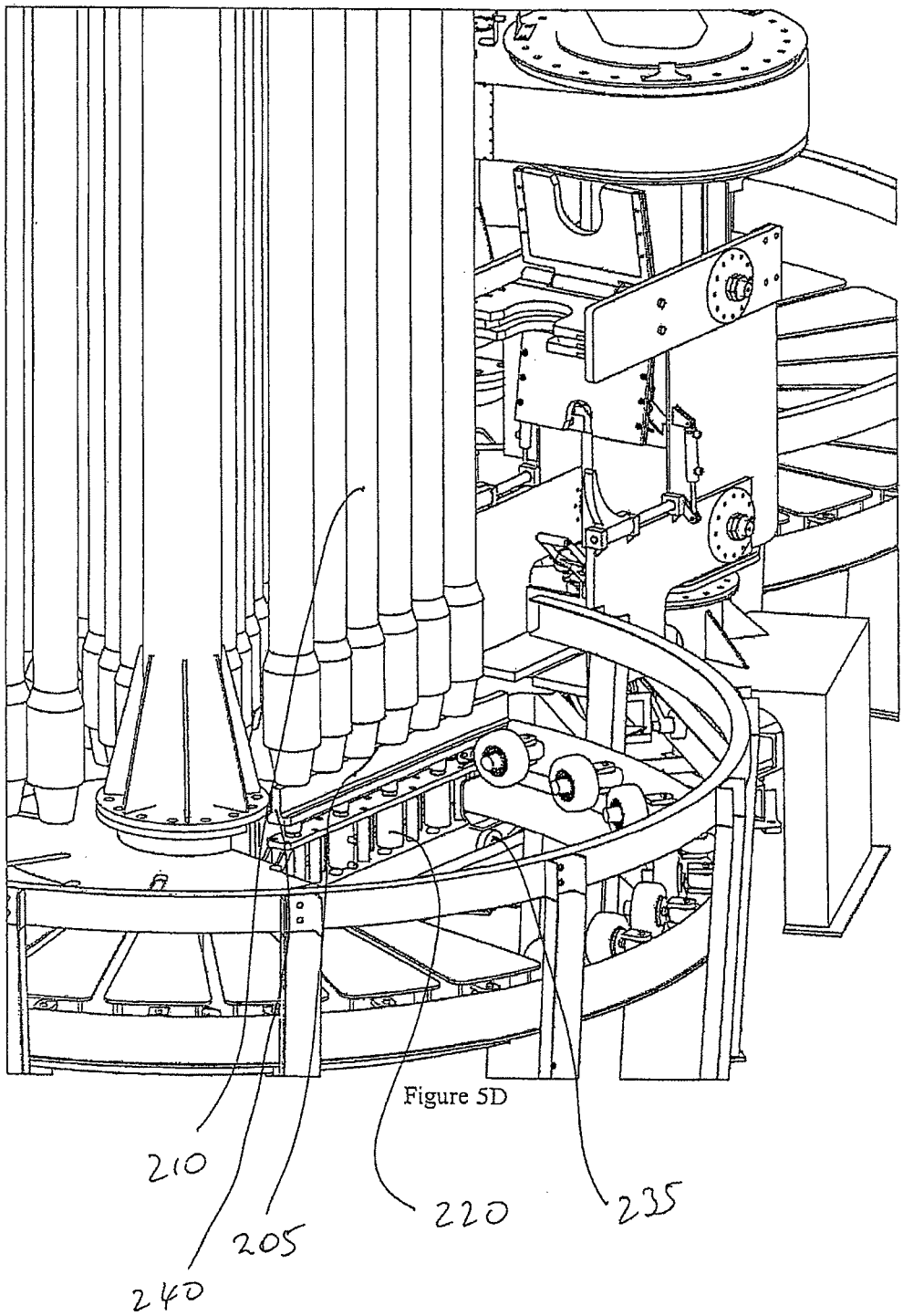

With regard to the process of insertion into the setback assembly, FIG. 5C shows a cut away view of the base to display the delivery system 200 in more detail. Here a different embodiment of the guide assembly 177 delivers several pipe stands 210 on top of a block 205. Rather than placing the pipe stands directly in the slot, placement on the block allows several pipe stands to be placed, so that they can be delivered to the racking assembly an array. Thus the block acts both as a "buffer" for collecting pipe stands as well as a means to deliver into the racking assembly and so may accommodate a greater number of pipe stands within a given time without causing a bottleneck for the guide assembly which in itself acts to free the racker arms as quickly as possible. Thus a further advantage of the guide assembly and delivery system individually, and in combination, is to avoid bottlenecks in "upstream" systems.

Thus the delivery system includes the block 205 which in this embodiment is placed upon a series of vertically oriented actuators (such as hydraulic rams) 220. The extension of the actuators 220 allows the block to move up and down relative to the base which is important in the means of delivery of the pipe stand. The block and actuators are located upon a trolley 230 which includes rollers 235. When the block has reached its capacity (either by weight of length) of pipe stands the delivery system moves into slots 215 within the base so as to bring the pipe stands into a closely packed arrangement on the base directed radially from the center. In a further embodiment, the block will be of sufficient size to contain a sufficient number of pipe stands to completely fill each radial line of storage of the base which of course must correspond to slots within the corresponding fingerboard.

Figure 5E:
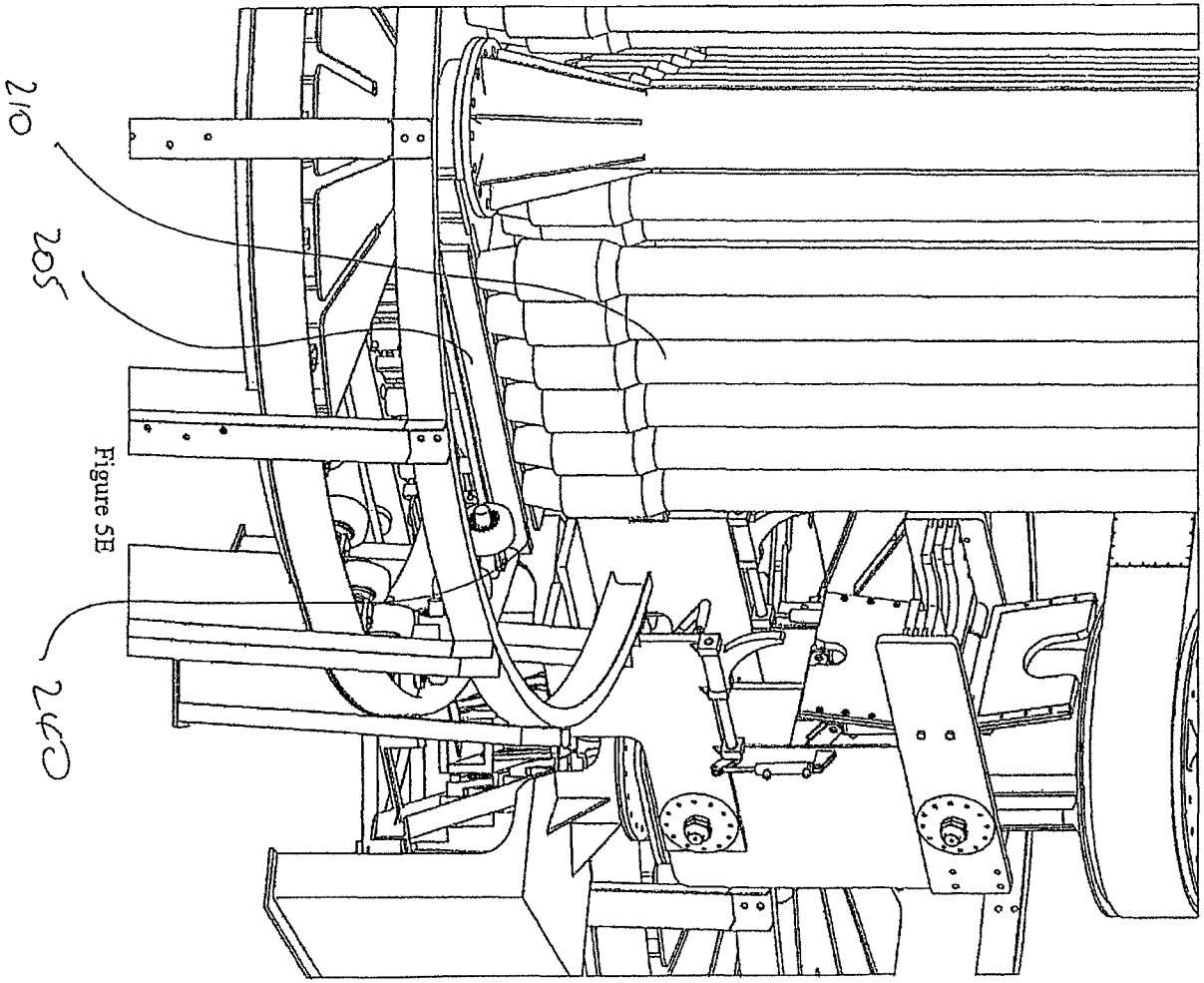

Once the block has reached the inner position as shown in FIG. 5C, the actuators 220 retract as shown in FIG. 5E. As the slot 215 in the base is sized to allow the block to project from and retract within the base, as the actuators 220 retracts and the block also retracts leaving the pipes, which are too large to pass through the slots, placed on the support face 245 of the base. The delivery system can then move the block in a retracted position using the trolley back to its original position for receiving further pipe stands.

In one embodiment the block may retract through the base so as to allow free rotation of the base without inference from the block. Alternatively, the trolley may permit the block to move completely out of the base so again may permit the base to rotate without interfering with the block.

In an alternative embodiment, the actuators may be replaced by upstands which are rotatable about a hinge. On rotation of the upstands, the block retracts beneath the support face, in a similar manner to the retraction of the actuators.

Figure 5F:
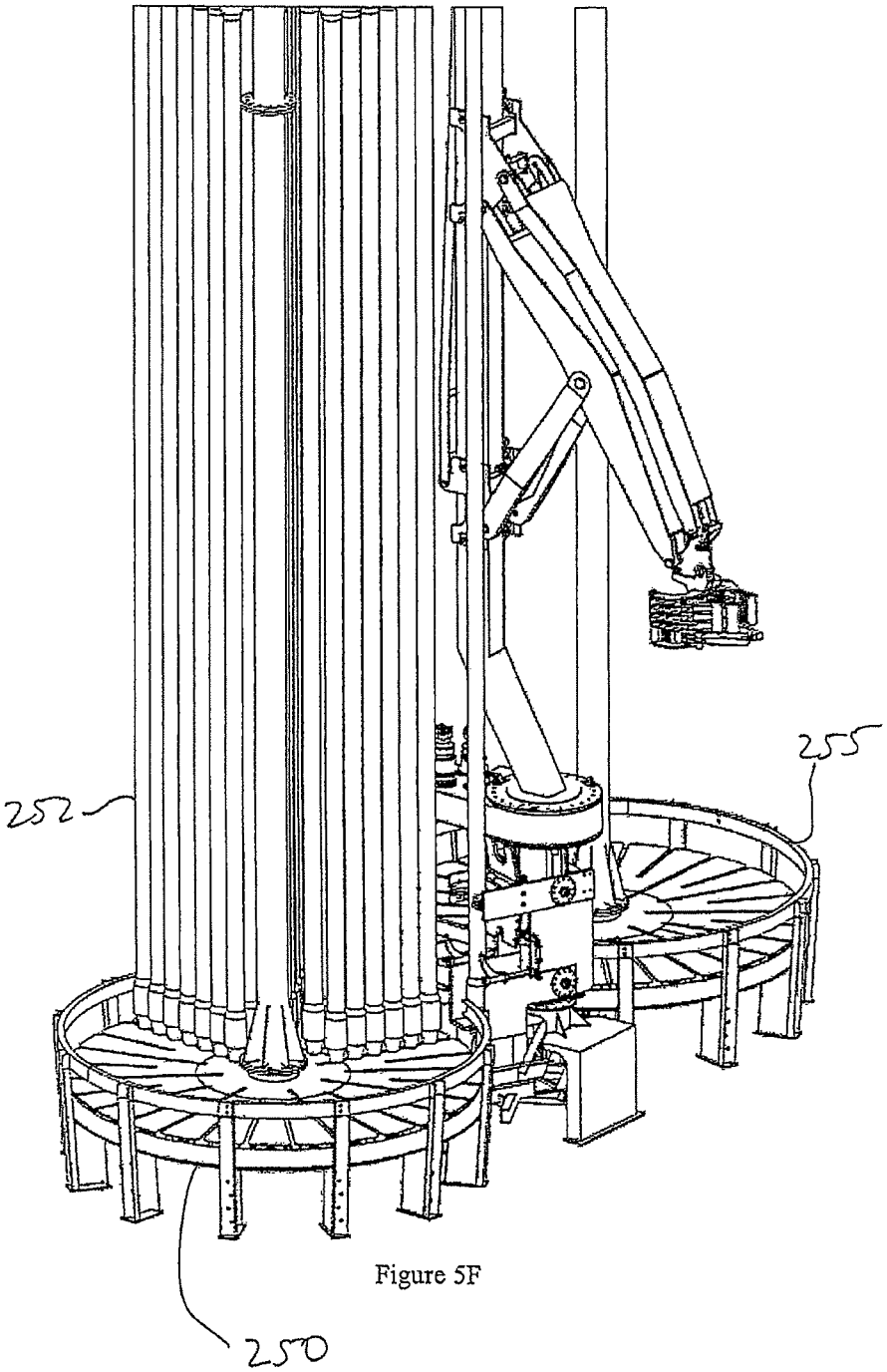

FIG. 5F shows partially completed storage of the pipe stand 252 which the first base 250 and second 255 both receiving pipe stand.

What is claimed is:

1. A racking assembly for receiving and storing at least one pipe, the racking assembly comprising a setback assembly including a selectively rotatable member having a plurality radial slots sized to receive a first portion of the at least one pipe in sliding engagement, and a base placed distal from the selectively rotatable member and coupled thereto so as to permit mutual rotation, said base arranged to support the at least one pipe on a support face of said base;

a barrier located about a peripheral edge of the base, such that the setback assembly rotates relative to the barrier, said barrier arranged to prevent the at least one pipe from moving radially from said base, said barrier having a gap sized to permit selective lateral movement of the at least one pipe, and;

a pipe delivery system comprising a support block for supporting the at least one pipe;

said base having at least one slot sized to allow the support block to project from or retract into said base, said slot further sized to prevent said pipe to pass there through, and;

a trolley arranged to move the block from a pipe receiving position to a pipe delivery position said pipe delivery position coinciding with the position at which the block retracts into the base so as to deliver the pipes to the base;

wherein mutual rotation of the selectively rotatable member and the base permit alignment of the gap and a selected slot of said selectively rotatable member, and so permitting the pipe stands to be moved laterally into said setback assembly, with the support block arranged to move along said slot, projecting from said slot with said pipe and to selectively retract below said base so as to position the pipe on said base.

2. The racking assembly according to claim 1 further including a pair of racker arms for gripping the at least one pipe and moving said pipe and so as to engage said slot and gap.

3. The racking assembly according to claim 2 further including a guide assembly for receiving said pipe from said racker arms so as to move the pipe to said slot and gap.

4. The racking assembly according to claim 1 wherein said setback assembly further includes a shaft connecting the selectively rotatable member and base.

5. The racking assembly according to claim 1 wherein said selectively rotatable member or base are circular with rotation about the center of said selectively rotatable member or base.

6. The racking assembly according to claim 1 wherein said more than one pipe is stored within the setback assembly, said pipes arranged in radial lines from a center of rotation of said selectively rotatable member and base.

7. The racking assembly according to claim 1, further including a second setback assembly.

8. The racking assembly according to claim 1 further including a plate located about a peripheral edge of the selectively rotatable member said plate including a gap through which the pipe can enter a selected slot when said slot correspond to said gap.

9. The racking assembly according to claim 6 further including a second pair of racker arms each pair of racker arms corresponding to two well centers such that the racking assembly can accommodate to two different well centers simultaneously.

10. The racking assembly according to claim 1, further including a guide assembly for receiving a pipe and moving said pipe to an outlet position, the assembly comprising a first and second support assembly for engaging the pipe, said assemblies in spaced relation to engage distal portions of said pipe;

said support assemblies arranged to rotate as a single entity so as to rotate the pipe from an engaging position to the outlet position.

11. The assembly according to claim 10 wherein the second support assembly further includes a base plate for supporting said pipe.

12. The guide assembly according to claim 10 wherein said pipe is received from a pair of racker arms.

13. The guide assembly according to claim 10 wherein said output station corresponds to an inlet to a setback assembly for storing said pipe.

14. The system according to claim 1 further including a retractor to selectively project and retract said block.

15. The system according to claim 14 wherein said retractor includes at least one linear actuator.

16. The system according to claim 14 wherein said retractor includes a plurality of upstands rotatably mounted to said block at a first end and pivotably mounted at an opposed second end, said upstands arranged such that in the vertical position the block projects from the base and in an inclined position the block retracts into said base.

17. The system according to claim 1 wherein said trolley includes any one of: a sliding assembly, a roller assembly or a chain drive.

* * * * *